US006019579A

United States Patent [19]

Fukuno et al.

[11] Patent Number: 6,019,579

[45] Date of Patent: Feb. 1, 2000

[54] GAS TURBINE ROTATING BLADE

[75] Inventors: Hiroki Fukuno; Yasuoki Tomita; Kiyoshi Suenaga, all of Takasago, Japan

[73] Assignee: Mitsubishi Heavy Industries, Ltd., Tokyo, Japan

[21] Appl. No.: 09/037,111

[22] Filed: Mar. 9, 1998

[30] Foreign Application Priority Data

Mar. 10, 1997 [JP] Japan ..... 9-054646

[51] Int. Cl.[7] ..... F01D 5/18

[52] U.S. Cl. ..... 416/97 R; 415/115; 415/116; 416/96 R; 416/96 A

[58] Field of Search ..... 415/114, 115, 415/116, 117; 416/95, 96 R, 96 A, 97 R; 60/39.75

[56] References Cited

U.S. PATENT DOCUMENTS

| | | | |
|---|---|---|---|
| 4,353,679 | 10/1982 | Hauser | 415/115 |
| 4,946,346 | 8/1990 | Ito | 415/115 |
| 5,120,192 | 6/1992 | Ohtomo et al. | 415/115 |
| 5,344,283 | 9/1994 | Magowan et al. | 415/115 |
| 5,382,135 | 1/1995 | Green | 416/97 R |
| 5,413,458 | 5/1995 | Calderbank | 415/115 |
| 5,634,766 | 6/1997 | Cunha et al. | 415/115 |
| 5,639,216 | 6/1997 | McLaurin et al. | 416/95 |
| 5,758,487 | 6/1998 | Salt et al. | 60/39.75 |
| 5,813,835 | 9/1998 | Corsmeier et al. | 416/97 R |
| 5,848,876 | 12/1998 | Tomita | 416/96 R |

OTHER PUBLICATIONS

Publication No. 09203301; English abstract of Japanese Patent Application No. 8–12811 (12811/1996), Publication date May 8, 1997.

Publication No. 09280002; English abstract of Japanese Patent application No. 8–92200 (92200/1996), Publication date Oct. 28, 1997.

*Primary Examiner*—Christopher Verdier

*Attorney, Agent, or Firm*—Alston & Bird LLP

[57] ABSTRACT

A gas turbine rotating blade comprises a serpentine passage provided in the blade width direction in plural rows in a blade profile portion except the portion near the trailing edge having a small blade thickness, a steam cooling passage provided around the outer periphery of a platform, an air passage provided in the blade width direction in the vicinity of the trailing edge of blade profile portion, an impingement plate provided under the platform on the inside of the steam cooling passage, slot holes formed so as to branch off from the air passage and be directed to the trailing edge, and slits formed in the platform above the impingement plate. Therefore, the blade profile portion is cooled by the steam passing through the serpentine passage and the air passing through the air passage, so that the cooling construction is not complicated, and cooling is performed effectively. For the platform, the outer periphery thereof is cooled by steam and the inside thereof by air effectively.

11 Claims, 4 Drawing Sheets

GAS TURBINE ROTATING BLADE

FIELD OF THE INVENTION AND RELATED ART STATEMENT

The present invention relates to a gas turbine rotating blade (moving blade) which is cooled from the inside using two cooling media by allowing steam and air as cooling media to separately pass through the inside of the rotating blade operating in a high-temperature gas.

Conventionally, a rotating blade operating in a high-temperature gas, which is used for a combined plant and the like, is provided with a cooling passage in the rotating blade to maintain a blade metal temperature below the allowable blade material temperature, so that the rotating blade is cooled from the inside by allowing a low-temperature compressed air to pass through this cooling passage. In such rotating blade cooling using compressed air, cooling methods such as convection cooling, impingement cooling, film cooling, shower head cooling, slot cooling, etc. which is corresponded to the blade inlet temperature, are used singly or in combination.

FIG. 4 is a sectional view of a rotating blade which is cooled from the inside by using compressed air.

As shown in FIG. 4, a leading edge 52 portion of a blade profile portion 51 of a rotating blade 50 is provided with an air passage 53 in the blade width direction, and cooling holes 56 are formed from the air passage 53 toward a leading edge 52, ventral side 54, and dorsal side 55. In the conventional gas turbine rotating blade, therefore, the air introduced from a blade root portion 65 is ejected into main flow gas F flowing at the periphery of the blade profile portion 51 through the cooling holes 56, by which the leading edge 52 portion is shower head cooled.

In the central portion in the chord direction of the blade profile portion 51, a plurality of rows of air passages 57 directed in the blade width direction are arranged in the chord direction. The air passages 57 are connected to each other at the blade end portion or blade base portion. In the conventional gas turbine rotating blade, therefore, a serpentine passage 58 is provided such that the air introduced into the front air passage 57 from the blade root portion 65 is allowed to flow to the rear air passage 57 successively, allowed to pass through the central portion while forming a zigzag flow, and allowed to flow out into the main flow gas F from the blade end of the rearmost air passage 57, by which the central portion is convection cooled from the inside. In this serpentine passage 58, turbulators 59 are provided in such a manner as to be inclined with respect to the air flow direction in order to make the flow of passing air turbulent to perform cooling efficiently with air of a low flow rate.

Further, shaped cooling holes 60 are formed so as to be directed from the serpentine passage 58 to the ventral side 54 and dorsal side 55 in the central portion of the blade profile portion 51. Thereupon, part of air flowing in the serpentine passage 58 is discharged to the side of the rotating blade 51, by which a cooling film is formed at the side in the central portion to perform film cooling.

More shaped cooling holes 60 are formed on the ventral side 54 than on the dorsal side 55 because the main flow gas F flowing on the ventral side in the central portion of the blade profile portion 51 has a high pressure, and the main flow gas F is difficult to flow if the air discharged to the dorsal side 55 forms a thick cooling film on the surface of the blade profile portion 51.

At a trailing edge 61 portion of the blade profile portion 51, an air passage 62 is provided in the blade width direction, and cooling holes 63 are formed at intervals in the blade width direction, one end thereof communicating with the air passage 62 and the other end thereof being open to the trailing edge 61.

In the air passage 62, like the serpentine passage 58, turbulators 64 are disposed in such a manner as to be inclined with respect to the air flow direction in order to perform cooling efficiently with air of a low flow rate.

Thus, the trailing edge 61 portion is cooled from the inside when the air introduced from the blade root portion 65 passes through the air passage 62 and the cooling holes 63. Also, the portion near the trailing edge 61, which is easily heated because the blade thickness must be decreased from the viewpoint of turbine performance, is effectively cooled by the air discharged into the main flow gas F through the cooling holes 63, which prevents the trailing edge 61 portion from being heated to a high temperature.

In the rotating blade 50 in which cooling is performed efficiently by discharging compressed air to the periphery of the blade profile portion 51 through the cooling holes 56, shaped cooling holes 60, and cooling holes 63 in addition to the convection cooling for cooling the blade from the inside when the air passes through the serpentine passage 58, if the flow rate of air discharged through these holes is too high, the discharged air is mixed with the main flow gas F immediately, resulting in a decrease in cooling effect. If the flow rate is too low, the cooling of the rotating blade 50 becomes insufficient. Therefore, care must be taken to ensure that the discharged air has the optimum flow rate.

The above is a description of a rotating blade which is cooled by using compressed air. However, as the gas turbine efficiency has recently been increased, the blade inlet temperature of rotating blade has increased to about 1500 degrees, so that in the air cooling system, a large quantity of air is required because air has a low heat capacity. Further, in the above-described cooling of rotating blade by using compressed air, it has become difficult to maintain the temperature of the rotating blade below the allowable blade material temperature.

For this reason, some rotating blades are adapted to use steam as a cooling medium in place of air because steam has a higher heat capacity than air and a smaller quantity is required. The applicant has proposed such a rotating blade in Japanese Patent Application No. 8-12811 titled "steam cooled rotating blade".

This rotating blade cools almost all portions of the blade profile portion by allowing steam to flow in a serpentine passage provided in the blade profile portion, and, in particular, strengthens the cooling of the rotating blade trailing edge portion which has a small blade thickness and low rigidity and is easily heated. Specifically, in the aforesaid rotating blade, the rearmost serpentine passage is partitioned by providing an impingement plate in the blade width direction to increase the cooling effect by impingement cooling in which the heat transfer coefficient is 5 to 10 times higher than the convection cooling and sufficient cooling can be performed. Thereby, the trailing edge portion with a small passage area is cooled to prevent the temperature of rotating blade from increasing to a value above the allowable blade material temperature.

In such a rotating blade using steam as a cooling medium, which is used for a combined plant and the like, the extraction steam of the steam turbine constituting the combined plant and the like is used as steam for cooling the rotating blade. Therefore, it is required, in view of the cycle of steam turbine, that all of the steam used for cooling be recovered and returned to the steam turbine, and the leakage of steam in the gas turbine be eliminated completely. Therefore, the steam passage provided in the rotating blade, through which steam is allowed to pass, must be constructed so as to closed to the outside.

For this reason, the aforesaid steam cooled rotating blade is provided with a steam supply port at the blade root portion and a steam discharge port for discharging the steam having been used to cool the rotating blade so that all of the steam used for cooling is recovered. Thus, the aforesaid rotating blade has an advantage that the blade profile portion of rotating blade can be cooled effectively by a small quantity of cooling medium and the temperature of rotating blade can be maintained at a value below the allowable blade material temperature because all of the water vapor having cooled the rotating blade is recovered and the thermal energy transmitted from the rotating blade in cooling can be recovered by the steam turbine. Further, the aforesaid rotating blade has an advantage that the efficiency of the whole combined plant can be improved.

However, in such a rotating blade, an impingement plate must be provided in the rearmost serpentine passage close to the trailing edge to recover all of the steam used for impingement cooling, so that the cooling construction of trailing edge portion is complicated. In addition, the blade thickness of the trailing portion is small. Therefore, the serpentine passage is difficult to form.

A platform portion, where a concentrated stress occurs when the rotating blade is rotated, has no special cooling construction, so that the platform is cooled insufficiently, resulting in a decrease in rigidity.

In the rotating blade which is cooled by steam, some portions of rotating blade can be cooled by air easily. Therefore, a rotating blade which is cooled both of steam and air has been devised. The applicant has proposed such a rotating blade in Japanese Patent Application No. 8-92200 titled "gas turbine rotating blade".

In this gas turbine blade, as shown in FIG. 5, steam 106 is allowed to flow in a serpentine passage 103 provided in the blade profile portion 101 of the rotating blade in the same manner as described above, by which the blade profile portion 101 is cooled. Also, a platform 102 at the base of the blade profile portion 101 is provided with a cooling passage, and cooling air 109 introduced through an air supply port 104 is allowed to flow in this cooling passage, by which the platform 102 is cooled. That is, two kinds of cooling media are used to cool the rotating blade. In FIG. 5, reference numeral 105 denotes a combustor, and 107 denotes a turbine rotor.

In this rotating blade, since the platform 102 is cooled by the cooling air 109, the decrease in rigidity of the platform 102 can be alleviated as compared with the aforesaid rotating blade in which only the blade profile portion of rotating blade is cooled by steam only. However, since the blade profile portion 101 is all cooled by the steam 106 like the aforesaid rotating blade, there still remains the aforesaid problem in that the serpentine passage 103 at the trailing edge portion is difficult to form. Also, since the platform 102 is cooled by air only, there still remains the problem in that the platform is cooled insufficiently, resulting in a decrease in rigidity.

OBJECT AND SUMMARY OF THE INVENTION

The present invention was made to solve the above problems with a rotating blade which is cooled by air, a rotating blade which is cooled by steam, and a rotating blade which is cooled by two kinds of cooling media, steam and air. Accordingly, an object of the present invention is to provide a reliable gas turbine rotating blade in which the portion in the blade profile portion of the rotating blade, which is preferably cooled by air, is cooled by supplying air; a platform, in which a concentrated stress occurs when the rotating blade is rotated and which requires strength, is cooled by supplying air, and cooling is also effected by supplying steam which can perform cooling effectively with a small quantity because of its high heat capacity. Therefore an increase in temperature of rotating blade is prevented by the effective cooling performed by properly using two kinds of cooling media, and the decrease in rigidity is alleviated.

Therefore, the gas turbine rotating blade in accordance with the present invention provides the following means:

(1) A serpentine passage is provided in the blade profile portion, each end of which is connected to a steam supply port and steam discharge port formed at a blade root portion, respectively. Thereby, the steam supplied through the steam supply port is allowed to flow in the blade width direction of the blade profile portion, is moved in the chord direction at the blade end portion or blade base portion, and is allowed to flow again in the blade width direction, such a flow being repeated plural times to form a zigzag flow in the blade profile portion. After the passing steam has cooled the blade profile portion, all of the steam used for cooling is discharged through the steam discharge port.

It is preferable that the serpentine passage be provided with turbulators to make the flow of passing steam turbulent, by which the heat transfer efficiency is increased, and the cooling effect is enhanced.

Also, it is preferable that the steam be introduced from the serpentine passage disposed on the trailing edge side of blade profile portion and allowed to flow to the serpentine passage on the leading edge side in succession.

Further, a plurality of lines of serpentine passages may be provided.

(2) A steam cooling passage is provided. Thereby, part of steam introduced into the serpentine passage through the steam supply port is divided to be allowed to flow around the outer periphery of a platform formed at the base of blade profile portion, and after the steam has cooled the platform, all of the steam used for cooling is joined to the steam discharged from the serpentine passage to the steam discharge port and discharged.

It is preferable that the steam cooling passage be provided so as to round the outer periphery of platform.

(3) An impingement plate is provided under the platform on the inside of the steam cooling passage formed around the outer periphery of platform. Thereby, the air, which is supplied in the axial direction of the rotating blade from a compressor and introduced through a supply port formed at the side of blade root portion, is blown to the lower surface of the outer peripheral portion of platform to perform impingement cooling.

It is preferable that the impingement plate be provided at a position keeping out of the central portion of platform, that is, the projected portion of blade profile portion, where the steam supply port and steam discharge port communicating with the serpentine passage are formed, to avoid interference with these ports.

(4) An air passage is provided in the blade width direction on the trailing edge side of the serpentine passage disposed closest to the trailing edge. Thereby, part of the air having passed through the impingement plate and been blown to the lower surface of platform to perform impingement cooling from the downside of platform is introduced and allowed to flow in the blade width direction, and then is discharged into a main flow gas flowing around the rotating blade through blade end slits formed at the blade end to cool the trailing edge portion.

It is preferable that the air passage be provided with turbulators to make the flow of passing air turbulent, by which the cooling effect is enhanced.

Further, it is preferable that the air discharged into the main flow gas from the air passage be discharged so as to form a flow along the blade end surface.

(5) Slits are formed penetrating the platform above the impingement plate from the lower surface to the upper surface in such a manner as to be inclined in the peripheral direction. Thereby, part of the air having been blown from the impingement plate to the lower surface of platform to impingement cool the platform is introduced and allowed to pass through, and is discharged from the upper surface of platform into the main flow gas to cool the platform.

It is preferable that the slit be formed in such a manner as to be inclined so that the air is discharged from the upper surface of platform into the flow of main flow gas so as to be directed from the ventral side of blade profile portion toward the rotating blade rotating direction and also the air is discharged from the dorsal side of blade profile portion toward the flow of main flow gas in the central portion of blade profile portion.

Although the allocation of flow rate of air introduced to the air passage after passing through the impingement plate and the flow rate of air allowed to flow through the slits can be controlled by providing an orifice etc. in the flow path to the air passage, it can also be controlled by regulating the opening areas of the blade end slits and slot holes, described later.

(6) A plurality of slot holes are provided at intervals in the blade width direction, one end thereof communicating with the air passage and the other end thereof being open to the trailing edge. Thereby, the air flowing in the air passage is divided and discharged from the trailing edge into the main flow gas to cool the trailing edge portion.

It is preferable that the slot hole be provided with an inclining portion lowering downward so that the air discharged from the opening of trailing edge into the main flow gas by the inclining portion flows in such a manner as to be inclined toward the base of blade profile portion.

The gas turbine rotating blade in accordance with the present invention is cooled by using two kinds of cooling media, steam and air, by the aforementioned means, so that the following effects can be achieved.

(1) The rotating blade can be cooled effectively with a low flow rate of cooling medium, and the temperature of the rotating blade can be maintained at a value below the allowable blade material temperature.

(2) Since all of the steam used for cooling can be recovered, there is no trouble of steam turbine cycle extracting air. Also, since the thermal energy of the heated steam can be reused, the efficiency as a combined plant can be increased.

(3) Since the quantity of cooling air can be reduced and steam has a higher heat capacity, the rotating blade can be cooled with a decreased total flow rate of steam plus air. Therefore, the size of the whole cooling medium passage formed in the rotating blade can be decreased, by which the decrease in rigidity of rotating blade can be alleviated.

(4) The gas turbine efficiency can be increased by the decrease in cooling air quantity.

In addition,

The leading edge portion, central portion, and trailing edge portion of the blade profile portion, where the serpentine passage can be formed easily, are cooled effectively by steam of a low flow rate, which has a high heat capacity. If the rotating blade portion which is cooled preferably by air, where the blade thickness is small and the temperature is high, is cooled by steam, the portion must have a complicated construction because all of the steam used for cooling must be recovered. For this reason, the trailing edge portion, where the flow path is difficult to form, is cooled by air. Therefore, the trailing edge portion can have a simple cooling construction, and can be cooled effectively by the air passing through the air passage and slot holes, so that the temperature of this portion can be decreased to a value below the allowable blade material temperature.

The platform, where a high concentrated stress occurs when the rotating blade is rotated, is cooled at the outer periphery by the steam flowing in the steam cooling passage, and is also cooled by various cooling methods using the air impinging on the lower surface from the impingement plate and the air flowing through the slits. Therefore, the high temperature can be prevented effectively, and the decrease in rigidity can be alleviated.

As described above, the gas turbine rotating blade in accordance with the present invention is configured so as to comprise the serpentine passage which communicates with a steam supply port and a steam discharge port formed at a blade root portion and in which a plurality of flow paths disposed in the blade width direction are arranged in the chord direction; the steam cooling passage in which a flow path communicating with the serpentine passage is formed around the outer periphery of the platform of rotating blade; the impingement plate which is disposed under the platform on the inside of the steam cooling passage; the air passage which is disposed in the blade width direction at the trailing edge portion of blade profile portion; the slits which are formed in the platform in such a manner as to be inclined in the peripheral direction; and the slot holes which are formed at intervals in the blade width direction from the air passage toward the trailing edge. Therefore, the rotating blade can achieve the following operations and effects.

The rotating blade can be cooled by using two kinds of cooling media, steam and air, so that the following effects can be achieved.

(1) The rotating blade can be cooled effectively with a low flow rate of cooling medium, and the temperature of the rotating blade can be maintained at a value below the allowable blade material temperature.

(2) Since all of the steam used for cooling can be recovered, there is no trouble of steam turbine cycle extracting air. Also, since the thermal energy of heated steam can be reused, the efficiency as a combined plant can be increased.

(3) Since the quantity of cooling air can be reduced and steam has a higher heat capacity, the rotating blade can be cooled with a lower total flow rate than before. Therefore, the cooling medium passage formed in the rotating blade can be made thin, by which the rigidity of rotating blade can be increased.

(4) The decrease in quantity of cooling air reduces the driving force of compressor driven by the gas turbine, so that the gas turbine efficiency can be increased.

In addition, (5) The leading edge portion, central portion, and trailing edge portion of the blade profile portion, where the serpentine passage of the rotating blade can be formed easily, are cooled effectively by steam of a low flow rate, which has a high heat capacity. Also, the trailing edge portion, which is difficult to cool by steam, is cooled by air. Therefore, the trailing edge portion can have a simple cooling construction, and the temperature of this portion can be decreased to a value below the allowable blade material temperature.

(6) The platform, where a high concentrated stress occurs when the rotating blade is rotated, is cooled at the outer periphery by the steam flowing in the steam cooling passage, and is also cooled by various cooling methods using the air flowing through the impingement plate and the slits. Therefore, the high temperature can be prevented effectively, and the decrease in rigidity can be alleviated.

DETAILED DESCRIPTION OF PREFERRED EMBODIMENTS

Figure 1:
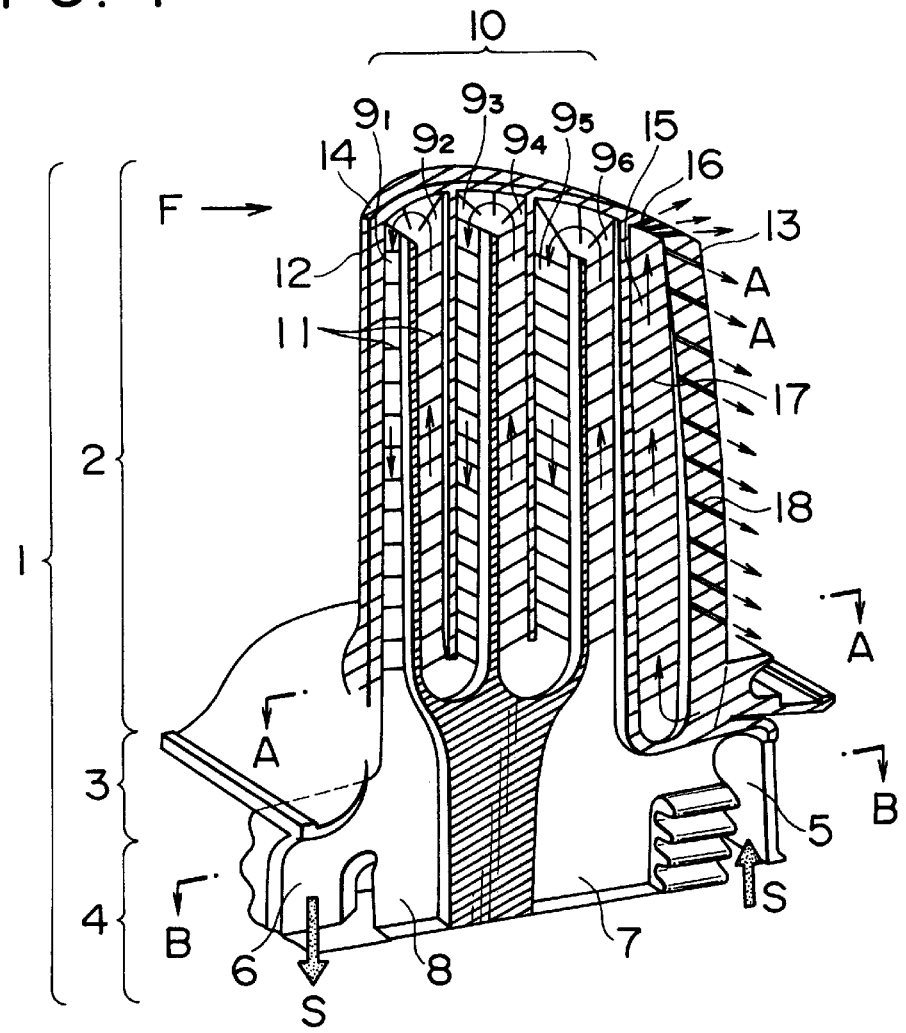
FIG. 1 is a longitudinal sectional view of a central portion in the blade thickness direction, showing a first embodiment of a gas turbine rotating blade in accordance with the present invention.
Figure 3:
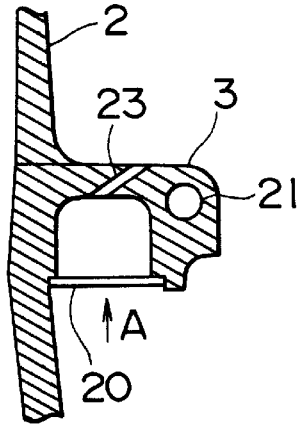
FIG. 3 is a longitudinal sectional view taken along the line C—C of FIG. 2(*a*)

One embodiment of a gas turbine rotating blade in accordance with the present invention will be described below with reference to the accompanying drawings. FIG. 1 is a longitudinal sectional view of a central portion in the blade thickness direction, showing a first embodiment of a gas turbine rotating blade in accordance with the present invention, FIG. 2(*a*) is a transverse sectional view taken along the line A—A of FIG. 1, FIG. 2(*b*) is a transverse sectional view taken along the line B—B of FIG. 1, and FIG. 3 is a longitudinal sectional view taken along the line C—C of FIG. 2(*a*).

As shown in FIG. 1, a rotating blade 1 comprises a blade profile portion 2, a platform 3, and a blade root portion 4.

Figure 5:
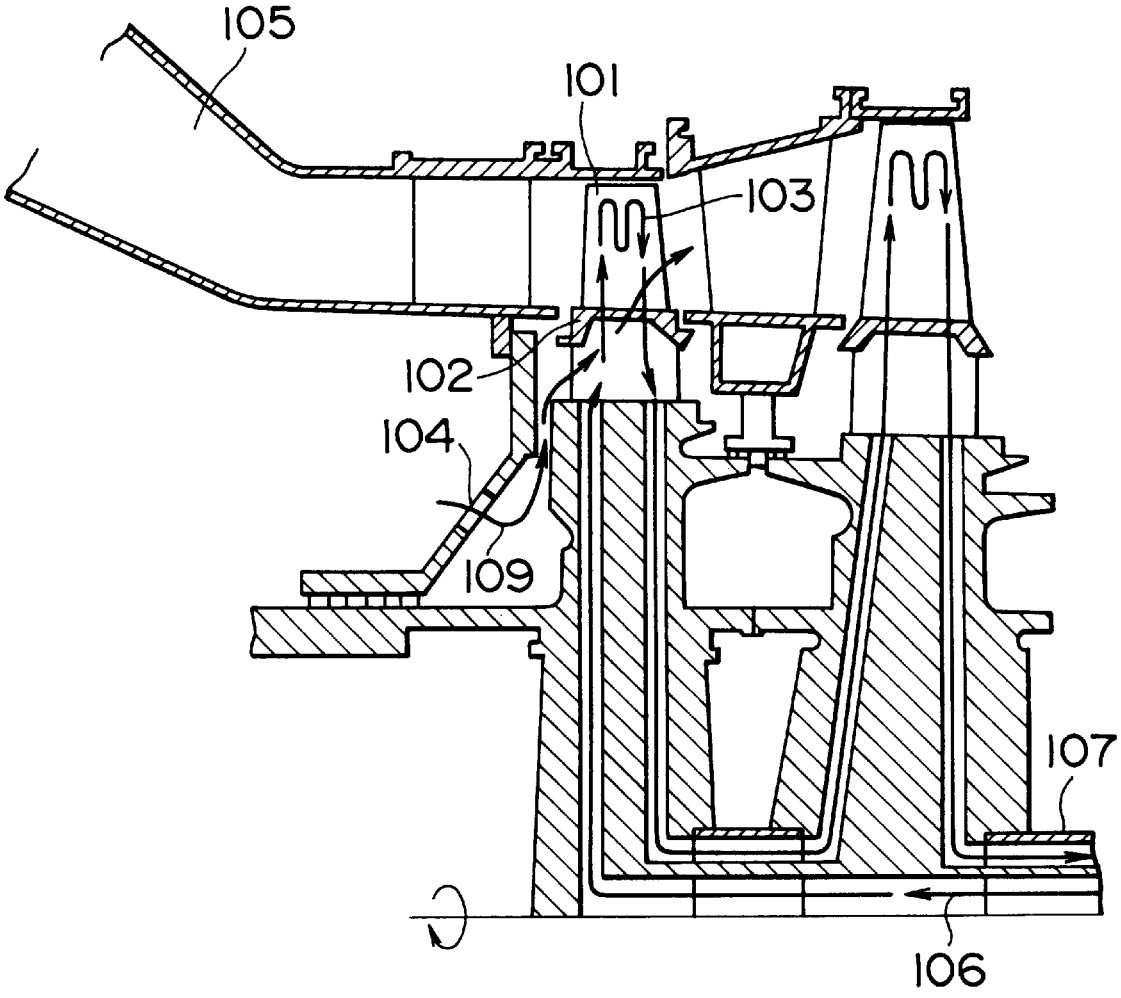
FIG. 5 is a longitudinal sectional view of a gas turbine rotating blade cooled by two kinds of cooling media, steam and air, which has been proposed by the applicant.

The blade root portion 4 is provided with a steam supply port 5 for supplying steam S supplied through a steam passage formed in a turbine rotor 107, as shown in FIG. 5, into the rotating blade 1 and a steam discharge port 6 for discharging the steam S having cooled the rotating blade 1. Cavities 7 and 8 are formed so as to communicate with the steam supply port 5 and steam discharge port 6, respectively. These cavities 7 and 8 are also formed in the central portion of the platform 3.

In the blade profile portion 2, six rows of flow paths 9 directed in the blade width direction are arranged in the blade chord direction from the leading edge 12 side toward the trailing edge 13 side. When numbered in sequence from the leading edge 12 side, a first-row flow path $\mathbf{9}_1$, and a second-row flow path $\mathbf{9}_2$, a third-row flow path $\mathbf{9}_3$ and a fourth-row flow path $\mathbf{9}_4$, and a fifth-row flow path $\mathbf{9}_5$ and a sixth-row flow path $\mathbf{9}_6$ are connected to each other at the blade end 14 portion. The second-row flow path $\mathbf{9}_2$ and the third-row flow path $\mathbf{9}_3$, and the fourth-row flow path $\mathbf{9}_4$ and the fifth-row flow path $\mathbf{9}_5$ are connected to each other at the base portion. Further, the base portion of the rearmost sixth-row flow path $\mathbf{9}_6$ is connected to the cavity 7, and the base portion of the foremost first-row flow path $\mathbf{9}_1$, is connected to the cavity 8.

Thereupon, the steam S supplied through the steam supply port 5 via the cavity 7 flows toward the blade end in the flow path $\mathbf{9}_6$, successively flows toward the blade base in the flow path $\mathbf{9}_5$, and repeats the flow direction in succession to flow toward the leading edge 12. Finally, the steam S flows toward the blade base in the flow path $\mathbf{9}_1$, flows to the steam discharge port 6 via the cavity 8, and flows out of the rotating blade 1. That is, these flow paths $\mathbf{9}_1$ to $\mathbf{9}_6$ constitute a serpentine passage 10 which forms a zigzag flow of steam in the blade profile portion 2. The serpentine passage 10 is provided with turbulators 11 inclined with respect to the flow direction so that the flow of the passing steam S is made turbulent to increase the heat transfer efficiency, by which the convection cooling effect is increased so that the blade profile portion 2 is convection cooled efficiently.

Also, an air passage 15 is provided in the blade width direction on the trailing edge 13 side of the rearmost sixth-row flow path $\mathbf{9}_6$. This air passage 15 allows air A having passed through an impingement plate 20, described later, to pass through. When the air A flows in the air passage 15, it convection cools the trailing edge 13 portion, and it is ejected into a main gas flow F through blade end slits 16 to film cool the blade end at the trailing edge 13 portion. This air passage 15 is provided with turbulators 17 to increase the cooling effect.

A plurality of slot holes 18 are formed on the trailing edge 13 side of the air passage 15, one end thereof communicating with the air passage 15 and the other end thereof being open to the trailing edge 13. These slot holes 18 are provided at equal intervals in the blade width direction and formed in such a manner as to be inclined downward so that the flow of air A flowing in the air passage 15 is divided, and the flow of air A ejected into the main flow gas F through the trailing edge 13 opening is directed toward the blade base. The air divided from the air passage 15 convection cools the trailing edge 13 portion when it passes through the slot holes 18.

Figure 2A:
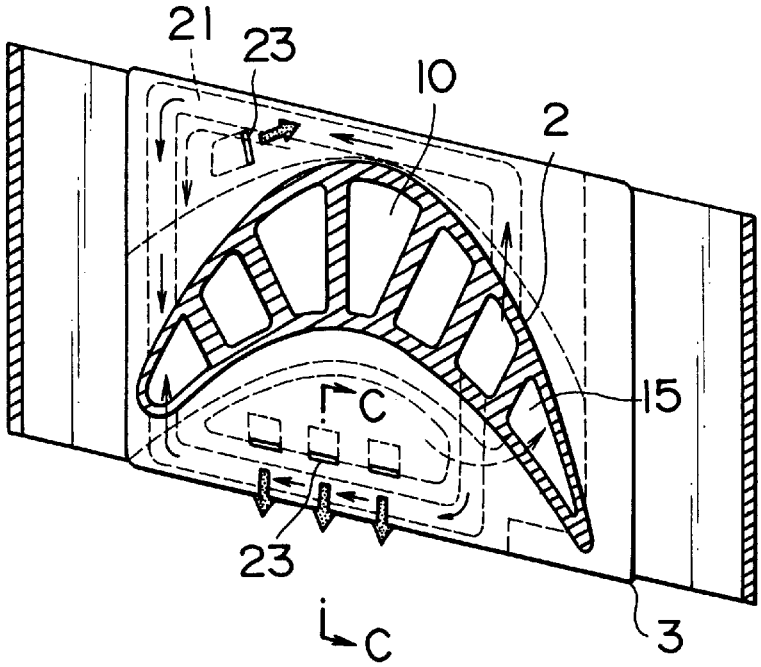
FIG. 2(*a*) is a transverse sectional view taken along the line A—A of FIG. 1, and FIG. 2(*b*) is a transverse sectional view taken along the line B—B of FIG. 1.
Figure 2B:
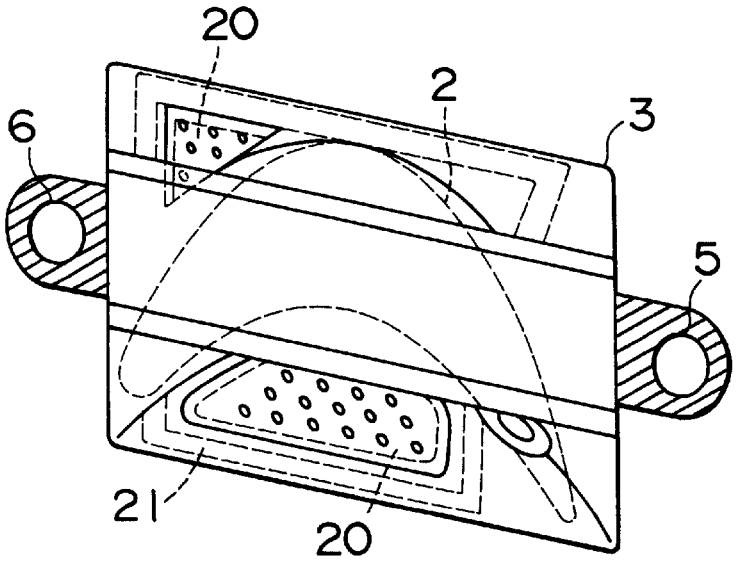
Figure 4A:
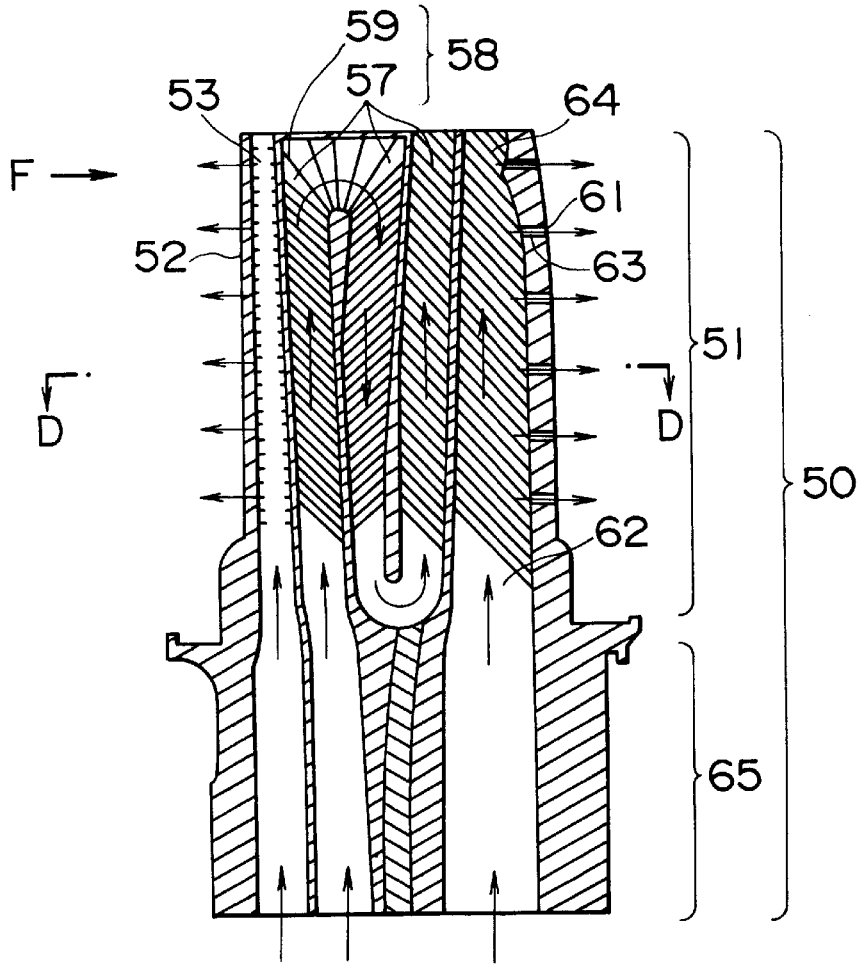
FIG. 4a (PRIOR ART)
FIG. 4(*a*) is a longitudinal sectional view of a central portion in the blade thickness direction, and FIG. 4(*b*) is a transverse sectional view taken along the line D—D of FIG. 4(*a*), showing a conventional air cooled gas turbine rotating blade.
Figure 4B:
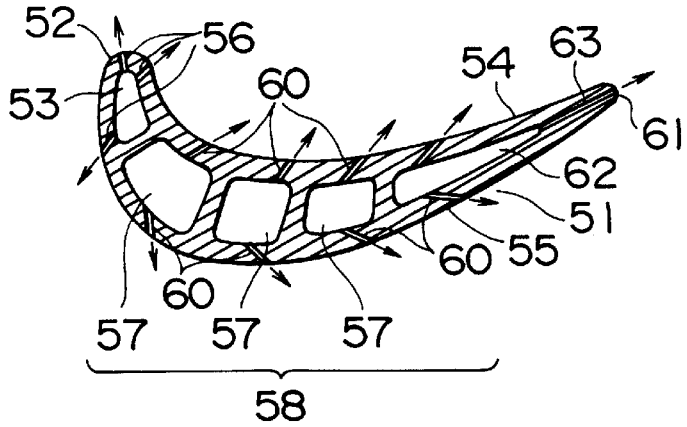
FIG. 4b (PRIOR ART)

The platform 3 is provided between the blade profile portion 2 and the blade root portion 4, and is formed with the cavities 7 and 8 in the central portion thereof as described above. As shown in FIG. 2, the platform 3 is provided with a steam cooling passage 21 around the outer periphery thereof. This steam cooling passage 21 communicates with the serpentine passage 10 so that part of steam supplied to the serpentine passage 10 through the steam supply port 5 is introduced into this steam cooling passage 21 to cool the outer periphery of the platform 3, and after cooling, the steam is joined to the steam flowing in the serpentine passage 10 and allowed to flow out.

The impingement plate 20 is disposed under the platform 3 on the inside of the arrangement position of the steam cooling passage 21 and on the outside of the projected portion of the blade profile portion 2 in the center. As shown in FIG. 5, the air supplied in the axial direction of the rotating blade 1 from an air compressor is introduced to the downside of the impingement plate 20 through the air supply port 104 formed at the side of the blade root portion 2, and impinges on the lower surface of the platform 3 through ejection holes formed in the impingement plate 20 to impingement cool the platform 3. Further, part of the air having cooled the platform 3 is supplied to the aforesaid air passage 15 of the blade profile portion 2 via orifice 22 while the flow rate is controlled by the orfice 22 in the air passage.

The platform 3 positioned above the impingement plate 20 is formed with a plurality of slits 23 at positions keeping out of the blade profile portion 2 on the platform 3 and the steam cooling passage 21 of the platform 3 so that the platform 3 is impingement cooled and the remaining air other than the air supplied to the air passage 15 is ejected onto the upper surface of the platform 3. As shown in FIG. 3, the slit 23 is formed in such a manner as to be inclined so as to be capable of ejecting the air toward the upper surface of the platform 3. Thereupon, when the air flows in the platform 3, it convection cools the platform 3, and film cooling the upper surface of the platform 3 by forming a cooling film of air thereon.

In the gas turbine rotating blade of this embodiment configured as described above, the steam S, one of the cooling media, passes through the steam supply port 5 from a flow path (not shown) in the gas turbine rotor, enters the cavity 7 communicating with the steam supply port 5, flows in the serpentine passage 10 provided with the slant turbulators 11, passes through the cavity 8 on the recovery side, and flows out to a recovery passage (not shown) in the gas turbine rotor through the steam discharge port 6. Part of the steam S flowing in the serpentine passage 10 circulates around the steam cooling passage 21 communicating with the serpentine passage 10 to cool the platform 3, passes through the cavity 8 on the recovery side, and flows out to a recovery passage (also not shown) in the gas turbine rotor through the steam discharge port 6.

Also, the air A, the other of the cooling media, is supplied to the downside of the impingement plate 20 provided on the lower side of the platform 3. After impingement cooling the platform 3, part of it flows in the air passage 15 to cool the trailing edge 13 portion, and part of the air passing through the air passage 15 is discharged into the main flow gas F through the slot holes 18 to further cool the trailing edge 13 portion. The remaining air having cooled the platform 3 is discharged into the main flow gas F through the slits 23 formed in the platform to further cool the platform 3.

We claim:

1. A gas turbine rotating blade which is cooled by allowing steam and air to flow separately in the rotating blade which operates in a high temperature gas, comprising: a serpentine passage for cooling a blade profile portion of said blade, and which communicates with a steam supply port and a steam of said blade; a plurality of flow paths disposed in the blade width direction arranged in the chord direction of said blade; a steam cooling passage for cooling a platform of said blade in which a flow path communicating with said serpentine passage is formed around the outer periphery of said platform of said rotating blade; an impingement plate for cooling said platform by allowing the air supplied through an air supply port at the side of the blade root portion to impinge on said platform said impingement plate being disposed under said platform on the inside of said steam cooling passage; an air passage for cooling a trailing edge portion of said blade by introducing air having passed through said impingement plate and discharging it into a main flow gas from the blade end, said air passage being disposed in the blade width direction at the trailing edge portion of blade profile portion; slits for cooling said platform by introducing air having passed through said impingement plate and discharging it into the main flow gas said slits being formed in said platform in such a manner as to be inclined in the direction of the periphery of said platform; and slot holes for cooling the trailing edge portion of said blade by discharging the air separated from said air passage into the main flow gas, said slots being formed at intervals in the blade width direction from said air passage toward the trailing edge portion of said blade.

2. A gas turbine rotating blade according to claim 1, wherein said serpentine passage is provided with turbulators for making the flow of passing steam turbulent.

3. A gas turbine rotating blade according to claim 1, wherein said air passage is provided with turbulators for making the flow of passing air turbulent.

4. A gas turbine rotating blade according to claim 1, wherein said slits are formed in such a manner as to be inclined so that air is discharged from the upper surface of said platform into the flow of main gas stream so as to be directed from the ventral side of blade profile portion toward the rotational direction of said blade and further wherein air is discharged from the dorsal side of blade profile portion toward the flow of main gas stream in the central portion of blade profile portion.

5. A gas turbine rotating blade according to claim 1, wherein said slot holes are each provided with an inclining portion lowering downward toward the base of the blade profile portion so that the air discharged from the opening of the trailing edge portion into the main gas stream by said inclining portion, flows in such a manner as to be inclined toward the bas of blade profile portion.

6. A gas turbine rotating blade adapted to be cooled by separately circulating steam and air in the blade, comprising:

a blade profile portion of said blade with a tip end and a root end, a platform attached at the root end of the profile portion, and a root attached to the platform;

the root defining a steam supply cavity and a steam discharge cavity therein and having a steam supply port for supplying steam to the steam supply cavity and a steam discharge port for removing steam from the steam discharge cavity, the root further having an air cavity and an air supply port for supplying air thereinto;

a serpentine steam passage formed in the blade profile portion and having plural flow path portions extending in a longitudinal direction between the tip and root ends, steam from the steam supply passage entering the serpentine passage and passing therealong and exiting therefrom into the steam discharge cavity;

a longitudinally extending air passage formed in a trailing edge portion of the blade profile portion and connected with the air cavity for receiving air therefrom;

the blade trailing edge portion including holes for supplying air from the air passage to external surfaces of the trailing edge portion for film cooling thereof;

an impingement plate disposed in the air cavity and including openings for air introduced into the air cavity to pass through said plate and impinge on a lower surface of the platform;

the platform including openings therethrough for film cooling an upper surface of the platform with air which has passed through the impingement plate; and a steam cooling passage formed in the platform about an outer periphery thereof and connected with the serpentine flow path for receiving steam therefrom.

7. The gas turbine rotating blade of claim 6 wherein the holes in the blade trailing edge portion are inclined downward toward the root end.

8. The gas turbine rotating blade of claim 6 wherein the openings in the platform include slits which discharge air into the main gas flow from a ventral side of the blade profile portion and are oriented to direct the air in the blade rotation direction.

9. The gas turbine rotating blade of claim 8 wherein the openings in the platform include slits which discharge air into the main gas flow from a dorsal side of the blade profile portion generally in the main gas flow direction.

10. The gas turbine rotating blade of claim 6, further comprising turbulators in the serpentine passage for inducing turbulent flow of steam therethrough.

11. The gas turbine rotating blade of claim 6, further comprising turbulators in the air passage for inducing turbulent flow of air therethrough.

* * * * *

UNITED STATES PATENT AND TRADEMARK OFFICE

CERTIFICATE OF CORRECTION

PATENT NO. : 6,019,579

DATED : February 1, 2000

INVENTOR(S) : Fukuno et al.

It is certified that error appears in the above-indentified patent and that said Letters Patent is hereby corrected as shown below:

Column 9, line 45, after "steam" insert --discharge port formed at a blade root portion--; line 51, after "allowing" cancel "the", line 53, after "platform" insert a comma (,); line 60, before "blade" insert --the--; line 62, after "gas" insert a comma (,).

Column 10, line 12, "main gas stream" should read --the main gas--; line 13, before "blade" insert --the--; line 15, before "blade" insert --the--; line 16, "main gas stream" should read --the main gas--; line 17, before "blade" insert --the--; line 22, "gas stream" should read --flow gas--; line 24, "bas of" should read --base of the--; line 63, "the", first occurrence, should read --a--.

Signed and Sealed this

Sixth Day of March, 2001

Nicholas P. Godici

*Attest:*

NICHOLAS P. GODICI

*Attesting Officer*

*Acting Director of the United States Patent and Trademark Office*